US011545749B2

(12) United States Patent
Gómez-Diaz et al.

(10) Patent No.: US 11,545,749 B2
(45) Date of Patent: Jan. 3, 2023

(54) NONRECIPROCAL AND RECONFIGURABLE PHASED-ARRAY ANTENNAS

(71) Applicant: The Regents of the University of California, Oakland, CA (US)

(72) Inventors: Juan Sebastián Gómez-Diaz, Davis, CA (US); Alejandro Álvarez-Melcón, Cartagena (ES); Jiawei Zang, Beijing (CN)

(73) Assignee: The Regents of the University of California, Oakland, CA (US)

( * ) Notice: Subject to any disclaimer, the term of this patent is extended or adjusted under 35 U.S.C. 154(b) by 341 days.

(21) Appl. No.: 16/931,281

(22) Filed: Jul. 16, 2020

(65) Prior Publication Data

US 2021/0021032 A1 Jan. 21, 2021

Related U.S. Application Data

(60) Provisional application No. 62/875,336, filed on Jul. 17, 2019.

(51) Int. Cl.
*H01Q 3/36* (2006.01)

(52) U.S. Cl.
CPC ..... *H01Q 3/36* (2013.01)

(58) Field of Classification Search
CPC ..... H01Q 3/36; H01Q 1/241; H01Q 1/247; H01Q 9/045; H01Q 21/08
See application file for complete search history.

(56) References Cited

U.S. PATENT DOCUMENTS 3,747,098 A * 7/1973 Kirkpatrick ..... H01Q 3/385 342/158
2013/0222056 A1* 8/2013 Lin ..... H04B 7/086 330/124 R (Continued)

OTHER PUBLICATIONS

Nonriciprocal Beam Phased Array Antennas Based on Transistor Loaded Phase Shifters, by Karimian et al. (Year: 2021).*

*Primary Examiner* — Awat M Salih
(74) *Attorney, Agent, or Firm* — Park, Vaughan, Fleming & Dowler LLP

(57) ABSTRACT

A nonreciprocal phased-array antenna includes an array of resonant antennas $a_1, \ldots, a_n$. During transmission, an outbound signal having a frequency $f_0$ and a phase shift $\varphi_{di}$ caused by propagation through a data network feeds into each resonant antenna $a_i$. Each resonant antenna $a_i$ upconverts the outbound signal using a modulation signal having a frequency $f_m$ and a phase shift $\varphi_{mi}$ caused by propagation through a modulation network to produce an upconverted radiated signal having a frequency $f_0+f_m$ and a phase proportionate to $\varphi_{di}+\varphi_{mi}$. During reception, an inbound signal of frequency $f_0+f_m$ is received at each resonant antenna $a_i$ and is downconverted using the modulation signal to produce a downconverted signal having a frequency $f_0$ and a phase proportionate to $-\varphi_{mi}$. After passing through the data network to the inbound port, the downconverted signal has a phase proportionate to $\varphi_{di}-\varphi_{mi}$.

13 Claims, 10 Drawing Sheets

(56) References Cited

U.S. PATENT DOCUMENTS

| | | | | |
|---|---|---|---|---|
| 2018/0088224 | A1* | 3/2018 | Kishigami | H01Q 21/06 |
| 2018/0241122 | A1* | 8/2018 | Jalali Mazlouman | H01Q 3/34 |
| 2019/0326664 | A1* | 10/2019 | Zhu | H01Q 3/38 |
| 2020/0333431 | A1* | 10/2020 | Völkel | G01S 7/03 |
| 2022/0200161 | A1* | 6/2022 | Takahashi | H01Q 3/36 |

* cited by examiner

NONRECIPROCAL AND RECONFIGURABLE PHASED-ARRAY ANTENNAS

CROSS-REFERENCE TO RELATED APPLICATION

This application claims the benefit of U.S. Provisional Patent Application Ser. No. 62/875,336, entitled "Nonreciprocal and Reconfigurable Phased-Array Antennas," by inventors Juan Sebastián Gómez-Diaz, et al., filed on 17 Jul. 2019, the contents of which are incorporated by reference herein.

GOVERNMENT LICENSE RIGHTS

This invention was made with U.S. government support under grant number CAREER-1749177 awarded by the National Science Foundation (NSF). The U.S. government has certain rights in the invention.

BACKGROUND

Field

The disclosed embodiments generally relate to the design of phased-array antennas. More specifically, the disclosed embodiments relate to the design of a nonreciprocal phased-array antenna, which generates different radiation patterns when operated in transmission or reception.

Related Art

Phased-array antennas are comprised of multiple antennas appropriately arranged in space to provide tailored and highly directive radiation patterns that can be electronically controlled without the need for mechanical rotation. They are ubiquitous in modern technology from radio frequencies to optical frequencies and find wide application in: military radar systems and tracking platforms, civilian automotive radars, light-detection-and-ranging (LIDAR) devices, satellite, wireless, and optical communications, radio astronomy, imaging, and remote and biological sensing among many others.

The first phased-array antenna was demonstrated in the early 1900s by employing a three-element switchable configuration to enhance the transmission of radio waves in one direction. (See A. Prasch, *DieFortschritte auf dem Gebiete der Drahtlosen Telegraphie* (*Progress in the Field of Wireless Telegraphy*) (Ferdinand Enke, Stuttgart, Germany, 1906), vol. 4, p. 184.) Although there has been continuous progress in phased-array antennas in the intervening decades, their basic operation principle has remained essentially unchanged: the amplitude and phase excitation of each antenna element is individually tailored in such a way that the radiated waves interfere constructively in desired directions and destructively in undesired ones.

The advantages of phased-array antennas over single radiating elements include significantly higher transmission gain, reception sensitivity, and power handling, as well as the ability to synthesize a large variety of radiation patterns. Additionally, ultra-rapid beam scanning and shaping can be realized by electrically manipulating the excitation of the antenna elements, usually through tunable feeding networks composed of digitally controlled phased shifters. Recently, smart antennas have merged sophisticated processing algorithms with antenna arrays to enable real-time functionalities, crucial in emerging 5G and optical communication systems. To this purpose, the amplitude and phases of the signals that feed each element of the antenna array are continuously updated as a function of the received waves. Application examples include finding the direction of arrival of unknown signals, adaptive beamforming, and multiple target tracking.

Phased-array antennas exhibit identical radiation patterns in transmission and reception due to the restrictions imposed by time-reversal symmetries. Merging nonreciprocal responses with the flexibility provided by smart antennas would make it possible to dynamically and independently control the transmission and reception properties of the array at the same operation frequency, opening exciting venues in communication and sensing systems and also in related areas of thermal management. Such an antenna would be able to efficiently handle unwanted interference and jamming signals that might otherwise block the device; mitigate cross-talking and mutual-coupling effects that often arise in electromagnetically crowded environments, such as in the roofs of buildings, ships, aircrafts, or integrated chips; enhance the channel diversity in multiple-input multiple-output (MIMO) radio links; and provide alternative knobs to boost the dynamic performance of radars, sensors, and wireless networks across the electromagnetic spectrum.

Unfortunately, there exist no tunable and nonreciprocal radiating elements that can serve as building blocks for such smart antenna systems. Early attempts to develop this type of antenna employed ferrites to break reciprocity, leading to devices that exhibited limited efficiency and whose tunable responses required the presence of bulky and lossy magnets, which are not compatible with integrated circuits.

Other attempts involved using gyrators or nonreciprocal phase shifters in the network that feed the elements of an antenna array, thus imparting different phases to the waves that are transmitted or received. One of the major challenges of using nonreciprocal phase shifters, which usually rely on magneto-optical effects or on active elements, is that the phase difference that they impart to waves that propagate in forward and backward directions is usually fixed and cannot be easily controlled. As a result, these components cannot be applied to realize antennas with independent transmission and reception radiation patterns.

Hence, what is needed is a phased-array antenna design that provides nonreciprocal response characteristics and enables independent transmission and reception radiation patterns to enhance the capabilities of new communication and sensing applications.

SUMMARY

The disclosed embodiments relate to a system that embodies a nonreciprocal phased-array antenna. This system includes an array of resonant antennas $a_1, \ldots, a_n$ as well as an outbound port that carries an outbound signal to be transmitted by the phased-array antenna, and an inbound port that carries an inbound signal received by the phased-array antenna. The system also includes a data network, which routes an outbound signal from the outbound port to each resonant antenna $a_i$ in the array of resonant antennas and, while doing so, imparts a phase shift $\varphi_{di}$ to the outbound signal, and which routes an inbound signal received at each resonant antenna $a_i$ to the inbound port and, while doing so, imparts a phase shift $\varphi_{di}$ to the inbound signal. The system additionally includes a modulation network that feeds a modulation signal having a frequency $f_m$ to each resonant antenna $a_i$ in the array of resonant antennas, wherein the modulation network imparts a phase shift $\varphi_{mi}$ to the modulation signal as the modulation signal is routed to a given resonant antenna $a_i$. During transmission, when an outbound signal is received at each resonant antenna $a_i$, the outbound signal is upconverted based on the modulation signal to produce an upconverted signal having a frequency $f_0+f_m$ and a phase proportionate to $\varphi_{di}+\varphi_{mi}$, and is radiated toward free space. During reception, when an inbound signal of frequency $f_0+f_m$ is received at each resonant antenna $a_i$, the inbound signal is downconverted based on the modulation signal to produce a downconverted signal having a frequency $f_0$ and a phase proportionate to $-\varphi_{mi}$, wherein after the downconverted signal passes through the data network to the inbound port, the downconverted signal has a phase proportionate to $\varphi_{di}-\varphi_{mi}$.

In some embodiments, each resonant antenna $a_i$ includes a junction that symmetrically connects the data network to opposite sides of the resonant antenna $a_i$, wherein the opposite sides form, with respect to the symmetry plane, a first side and a second side. The first side includes a nonlinear component that mixes the frequency $f_0$ with the modulation frequency $f_m$. The second side also include a nonlinear component that mixes the frequency $f_0$ with the modulation frequency $f_m$ which has a phase difference of approximately 180° with respect to the one employed in the other side. In these embodiments, the resonant antenna $a_i$ exhibits two coupled-resonances, an even one at frequency $f_0$ with respect to the input port, and an odd one at $f_0+f_m$ with respect to free-space.

In some embodiments, the nonlinear components include varactors that act as tuning elements for the two resonant modes of the antenna.

In some embodiments, the second side is not modulated and does not include a nonlinear component.

In some embodiments, during transmission, the first and second sides of the structure collectively excite the resonant modes of the antenna $a_i$. The input energy excites the structure time-modulated even mode at $f_0$, and then is coupled to the antenna odd mode at $f_0+f_m$ and radiated to free-space with a phase $\varphi_{di}+\varphi_{mi}$.

In some embodiments, during reception, the signal coming from free-space at a frequency $f_0+f_m$ excites the time-modulated odd mode of the antenna $a_i$. The energy is then coupled to the even mode at $f_0$ with a phase $\varphi_{di}-\varphi_{mi}$ and is passed into the data network.

In some embodiments, each resonant antenna $a_i$ comprises: a substrate composed of a dielectric material having a top surface and a bottom surface; a ground plane comprising a metal layer bonded to the bottom surface of the substrate; a patch antenna comprising a shaped metal sheet mounted on the top surface of the substrate; a microstrip line printed on the top surface of the substrate that is connected to the data network and forms a junction to feed the patch antenna from the opposite sides; two coplanar waveguides (CPWs) located in the ground plane, wherein each CPW is beneath the microstrip lines that feed the patch antenna, wherein the two CPWs carry the modulation signal and the inverse modulation signal; and two via-holes, each of which is loaded with a varactor and located on one side of the patch antenna to connect the microstrip line and the CPW located beneath the patch antenna.

In some embodiments, the modulation network includes phase shifters that impart a phase shift $\varphi_{mi}$ to the modulation signal as the modulation signal is routed to each resonant antenna $a_i$.

In some embodiments, radiation patterns generated by the entire phased-array antenna during transmission and reception can be independently controlled by modifying the phases $\varphi_{di}$ and $\varphi_{mi}$.

DETAILED DESCRIPTION

Figure 1A:
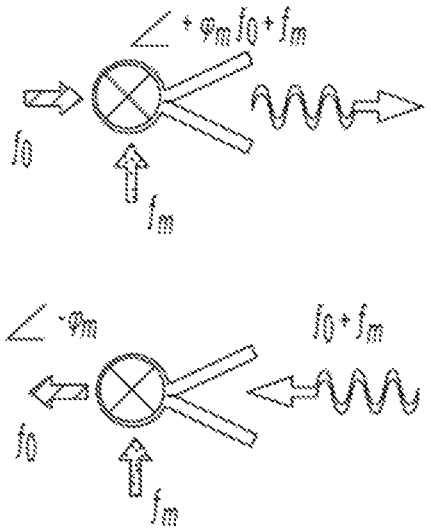
FIG. 1A presents a schematic diagram of a nonlinear resonant antenna, which has an electromagnetic response that is modulated by a signal having a frequency $f_m$ and a phase $\varphi_m$, in accordance with the disclosed embodiments.

The following description is presented to enable any person skilled in the art to make and use the present embodiments, and is provided in the context of a particular application and its requirements. Various modifications to the disclosed embodiments will be readily apparent to those skilled in the art, and the general principles defined herein may be applied to other embodiments and applications without departing from the spirit and scope of the present embodiments. Thus, the present embodiments are not limited to the embodiments shown, but are to be accorded the widest scope consistent with the principles and features disclosed herein.

The data structures and code described in this detailed description are typically stored on a computer-readable storage medium, which may be any device or medium that can store code and/or data for use by a computer system. The computer-readable storage medium includes, but is not limited to, volatile memory, non-volatile memory, magnetic and optical storage devices such as disk drives, magnetic tape, CDs (compact discs), DVDs (digital versatile discs or digital video discs), or other media capable of storing computer-readable media now known or later developed.

The methods and processes described in the detailed description section can be embodied as code and/or data, which can be stored in a computer-readable storage medium as described above. When a computer system reads and executes the code and/or data stored on the computer-readable storage medium, the computer system performs the methods and processes embodied as data structures and code and stored within the computer-readable storage medium. Furthermore, the methods and processes described below can be included in hardware modules. For example, the hardware modules can include, but are not limited to, application-specific integrated circuit (ASIC) chips, field-programmable gate arrays (FPGAs), and other programmable-logic devices now known or later developed. When the hardware modules are activated, the hardware modules perform the methods and processes included within the hardware modules.

Discussion

The building block of the nonreciprocal phased-array comprises a time-modulated resonant antenna element that provides very efficient frequency conversion between only two frequencies: one associated with waves propagating in free space; and the other related to guided signals. Controlling the tunable nonreciprocal phase response of these elements with the phase of low-frequency modulation signals makes it possible to independently tailor the transmission and reception radiation patterns of the entire array. Measured results at microwaves confirm isolation levels over 40 dB at desired directions in space with an overall loss below 4 dB. This concept can likely be extended across the electromagnetic spectrum (provided adequate tuning elements are available) with important implications in communication, sensing, and radar systems, as well as in thermal management and energy harvesting.

The fundamental building block of our proposed platform is a time-modulated resonant antenna that is simultaneously excited from two ports. By appropriately imposing even and odd symmetries at nonlinear harmonics frequencies through a feedback mechanism, it is possible to enforce very efficient frequency conversion between only two frequencies associated with signals guided in the structure and waves propagating in free space. This approach facilitates implementing efficient time-modulated resonant antennas in which the mixer is part of the device and takes advantage of its resonant behavior to implement photonic transitions across the electromagnetic spectrum, including the realm of infrared and optics, without relying on complex digital circuits. The phase response of the resulting antenna element when operated in transmission or reception is controlled in a nonreciprocal manner through the phase of a low-frequency modulating signal. Nonreciprocity in the phase arises due to the photonic Aharonov-Bohm effect in which reverting the direction of the photonic transition—that is, from transmission to reception—changes the sign of the induced phase and can also be understood in terms of nonlinear phase conjugation, a technique usually employed in the design of mixers.

By simply manipulating the phases of the modulating signals, it is possible to: favor the transmission or reception of energy at desired directions; obtain common reciprocal radiation patterns; and implement beam-scanning functionalities. Even more sophisticated functionalities can be obtained by increasing the number of radiating elements and gathering them in two-dimensional arrangements. We emphasize that the proposed nonreciprocal antenna concept can be implemented with different technologies at any frequency band provided that adequate reconfigurable materials or components are available.

Principle of Operation

Consider a resonant and nonlinear antenna that is time-modulated with a signal with low frequency $f_m$ and phase $\varphi_m$. The nonlinear process occurring in the antenna generates nonlinear harmonics at frequencies $f_0+nf_m$ (with $n\in$ □). By tailoring the antenna's resonant response and exploiting symmetry constraints, as described below, it is possible to achieve very efficient frequency conversion between only two frequencies: one associated with waves propagating in free space; and the other related to the signals within the antenna feeding network. It should be stressed that this nonlinear frequency conversion process is not reciprocal either in phase or in amplitude. The operation principle of the resulting time-modulated antenna, assuming frequency conversion with the first odd nonlinear harmonics ($n=\pm1$), is as follows. In transmission, as is illustrated in the top of FIG. 1A, the antenna upconverts the excitation signals oscillating at $f_0$ to $f_0+f_m$ ($n=+1$) and radiates them toward free space with a phase proportional to $+\varphi_m$. In reception, as is illustrated in the bottom of FIG. 1A, the antenna receives incoming waves oscillating at $f_0+f_m$ and downconverts them to $f_0$ ($n=-1$) with a phase proportional to $-\varphi_m$. Strong nonreciprocity in the phase appears during the transmission and reception of waves, associated with phase conjugation during up and down frequency conversion processes and due to the photonic Aharonov-Bohm effect. Note that the conversion efficiency of these processes is very similar when the modulation frequency $f_m$ is significantly smaller than the operation frequency (i.e., $f_m \ll f_0$).

Figure 1B:
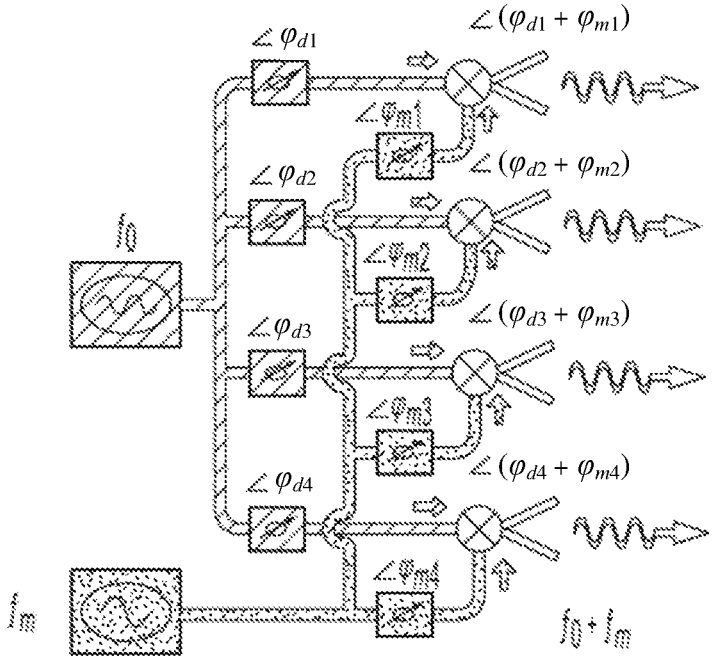
FIG. 1B presents a diagram illustrating a nonreciprocal phased-array antenna operating in transmission in accordance with the disclosed embodiments.

Using time-modulated antennas as radiating elements, nonreciprocal phased arrays with drastically different radiation patterns in transmission and reception can be constructed. FIG. 1B presents a diagram of a linear array configuration operating in transmission. The device consists of a feeding network for a data signal oscillating at $f_0$, a second feeding network that incorporates phase shifters for a low-frequency modulation signal $f_m$, and identical nonlinear antenna elements. Applying an array factor approach, the electric field $E_t$ radiated by the array at $f_0+f_m$ can be approximately computed $$E_c(\theta, \varphi) = E_{ant}(\theta, \varphi)\sum_{i=1}^{P} w_p e^{j(\varphi_{di}+\varphi_{mp})} \tag{1}$$

where $E_{ant}(\theta, \varphi)$ denotes the radiation pattern of the individual antenna, with $\theta$ and $\varphi$ being the elevation and azimuth angles in spherical coordinates, respectively. P is the total number of antennas in the array. $w_i$ and $\varphi_{di}$ are the amplitude and phase of the signal $f_0$ that feed an antenna element "i," and $\varphi_{mi}$ is the phase of the signal oscillating at $f_m$ that modulates the antenna element "i." This approach can be extended to consider arbitrary planar arrangements of antennas instead of the simple linear configuration employed here. The transmission radiation pattern in Eq. (1) can be tailored using common beamforming synthesis techniques that rely on controlling the excitation amplitude $w_i$, the phases $\varphi_{di}$, and, in this scheme, also the phases $\varphi_{mi}$. In particular, manipulating $\varphi_{mi}$ is advantageous because it requires phase shifters operating at the low frequency $f_m$ and avoids locating them in the path of the transmitted and received signals, which significantly reduces the impact of phase shifter loss and other effects to the overall performance of the array.

Figure 1C:
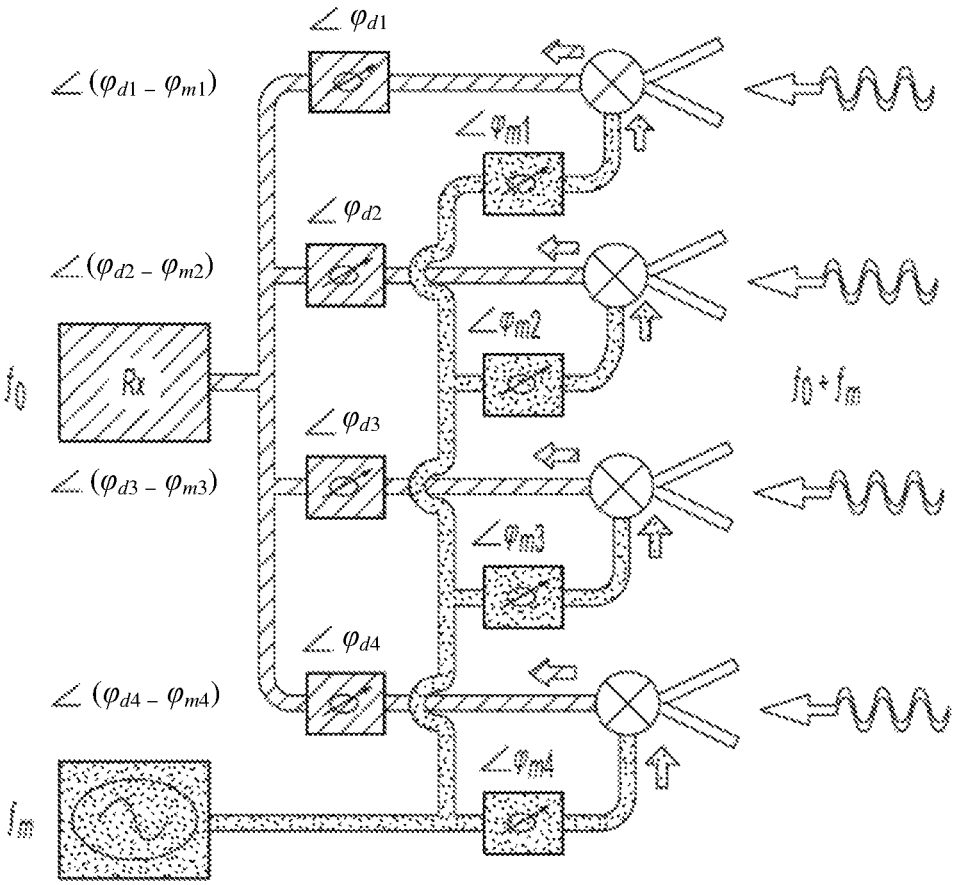
FIG. 1C presents a diagram illustrating a nonreciprocal phased-array antenna operating in reception in accordance with the disclosed embodiments.

Consider now the phased-array antenna operating in reception, as illustrated in FIG. 1C. Using the array factor employed before, the radiation pattern of the antenna operating in reception, $E_r$, can be computed as $$E_c(\theta, \varphi) = E_{ant}(\theta, \varphi)\sum_{i=1}^{P} w_p e^{j(\varphi_{di}+\varphi_{mp})} \tag{2}$$

We stress that the array receives waves coming from free space that oscillates at $f_0+f_m$ and downconverts them to guided waves at $f_0$ (n=−1), which enforces a change of sign in the phases $\varphi_{mi}$ with respect to the transmission case. A simple analysis of Eqs. (1) and (2) reveals that appropriately controlling the phases $\varphi_{di}$ and $\varphi_{mi}$ makes it possible to drastically shape different radiation patterns in transmission and reception by taking advantage of available beamforming synthesis techniques. For instance, if all antenna elements are fed with the same phase at $f_0$, that is, constant $\varphi_{di}$ ∀i, the spatial angles of maximum transmission and reception of energy will always be opposite $$(\theta_t^{max}, \phi_t^{max}) = (-\theta_r^{max}, -\theta_r^{max}),$$

where the subscripts "r" and "t" denote reception and transmission, respectively. Even greater flexibility and exciting functionalities can be obtained by also controlling the phases of the elements at $f_0(\varphi_{di})$, including tuning the spatial angle of maximum transmission (reception) in real time while simultaneously preventing any reception (transmission) of energy from (to) that direction.

Exploiting Symmetries in Nonlinear Resonant Antennas

We introduce here an approach to achieve very efficient frequency conversion between spatial and guided waves in nonlinear resonant antennas based on exploiting even and odd symmetries in the structure through a feedback mechanism. The resulting antennas exhibit the desired nonreciprocity in phase, following the scheme shown in FIG. 1A.

Figure 2A:
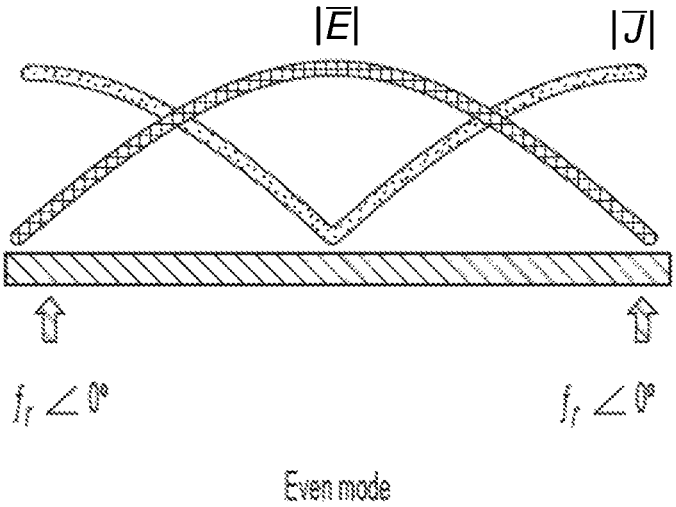
FIG. 2A presents a graph illustrating the surface current and electric field for an even mode of a modulated resonant antenna in accordance with the disclosed embodiments.
Figure 2B:
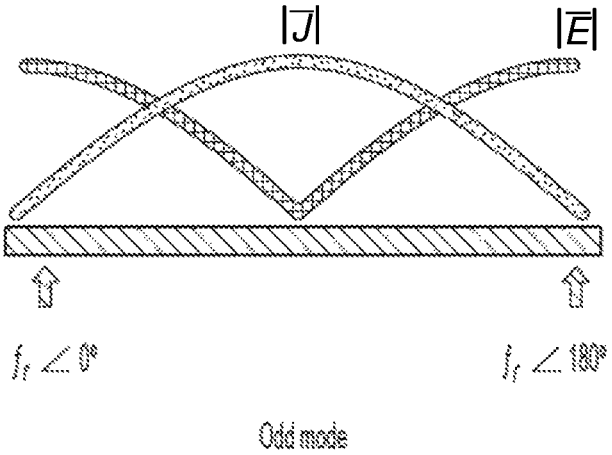
FIG. 2B presents a graph illustrating the surface current and electric field for an odd mode of the modulated resonant antenna in accordance with the disclosed embodiments.

Consider a resonant, linear, half-wavelength antenna, such as a dipole or a patch antenna, with a resonant frequency $f_r$ and a bandwidth Δf. This type of structure supports surface currents (electric fields) with an even (odd) symmetry with respect to the center of the antenna, as illustrated in FIG. 2A. Such symmetries can be further manipulated by simultaneously exciting the antenna from two symmetrical ports. The equivalent circuit of such a device is composed of two identical resonators coupled through a resistor $R_{rad}$ that models the antenna radiation to free space. When the exciting signals are in phase, the symmetric (even) mode of the antenna is excited, thus preventing any current flowing on $R_{rad}$ and, in turn, any radiation to free space. The surface currents and electric field induced along the structure in this case exhibit odd and even symmetries, respectively. When the exciting signals are 180° out of phase, the antisymmetric (odd) mode is excited. Then, currents can flow through $R_{rad}$ and the total radiation to free space is maximized. For the sake of simplicity, we neglect the presence of dissipation loss in this simple model, but it can easily be included by incorporating additional resistors in the circuit.

Figure 2C:
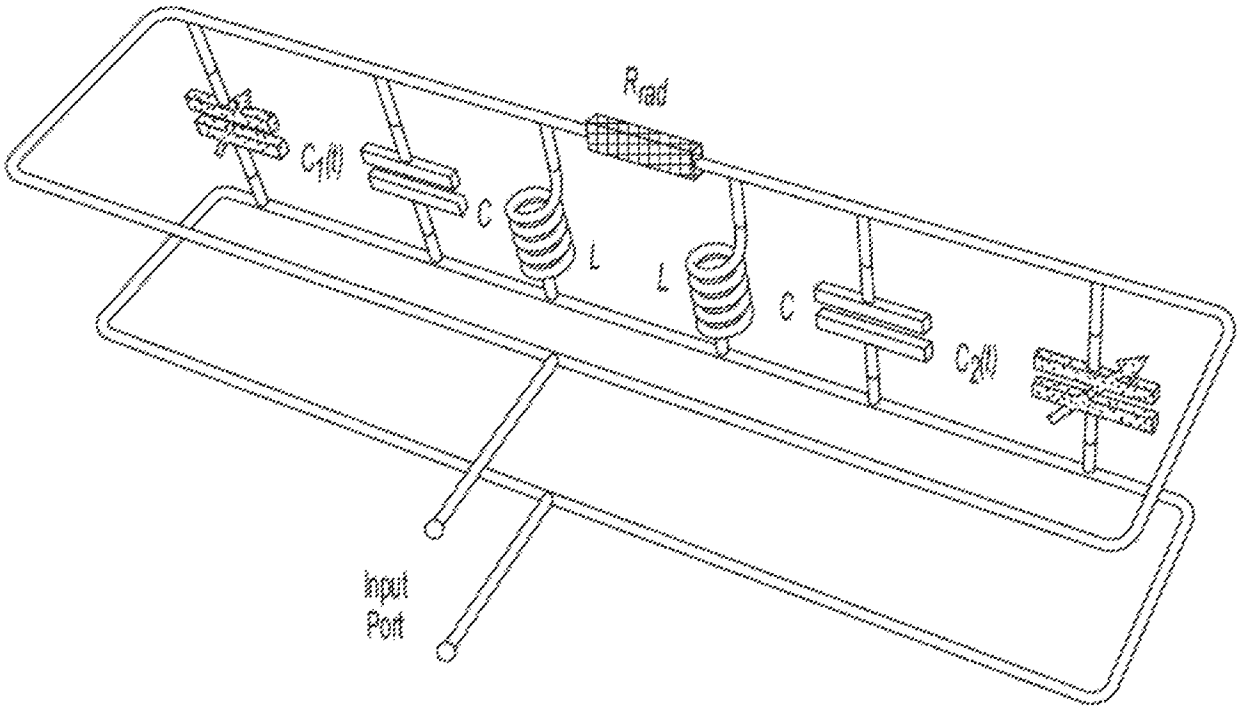
FIG. 2C presents a schematic diagram illustrating an equivalent circuit for the modulated resonant antenna in accordance with the disclosed embodiments.
Figure 2D:
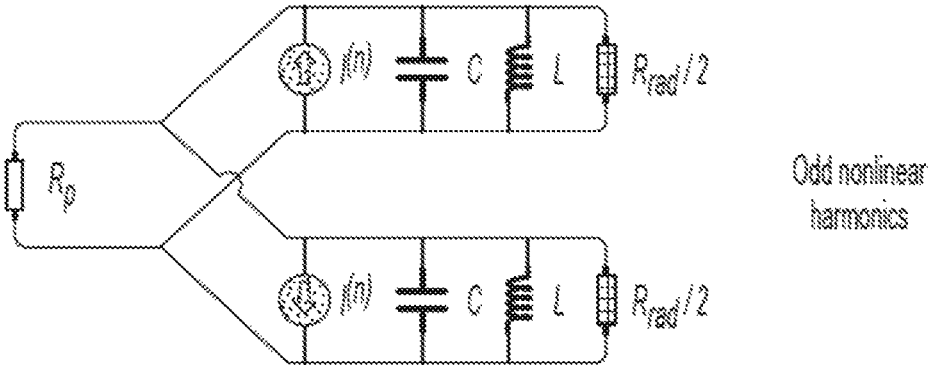
FIG. 2D presents a schematic diagram illustrating an equivalent circuit for the case where odd harmonics impose an odd symmetry in the antenna structure in accordance with the disclosed embodiments.
Figure 2E:
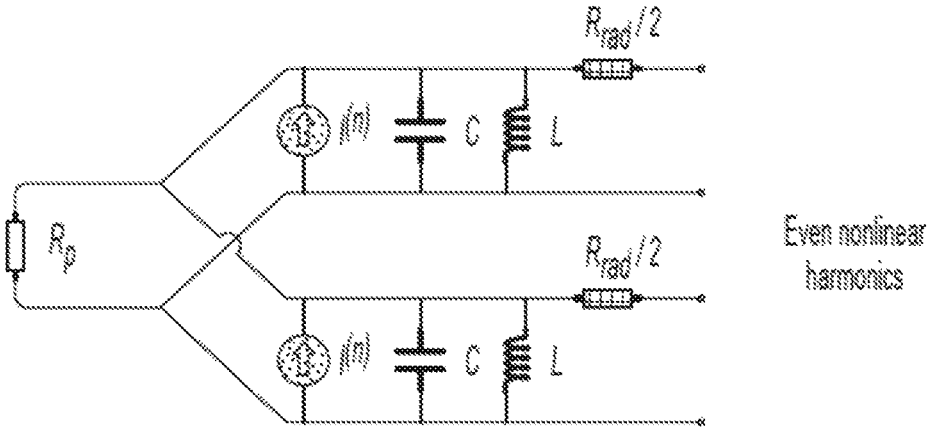
FIG. 2E presents a schematic diagram illustrating an equivalent circuit for the case where even harmonics impose an even symmetry in the antenna structure in accordance with the disclosed embodiments.

We propose to exploit the properties of even and odd modes to implement electromagnetic resonances for spatial and guided waves that will enable very efficient frequency conversion between them. To do so, we first feed the two ports of the antenna from the same input line, creating a loop that serves as a feedback mechanism. Second, we will include a variable capacitor on each resonator as a tuning element. An equivalent circuit of the resulting antenna is shown in FIG. 2C. Moreover, an equivalent circuit for the case of odd harmonics is illustrated in FIG. 2D, and an equivalent circuit for the case of even harmonics is illustrated in FIG. 2E. The varactors are time-modulated following $$C_1(t) = C_0[1+\Delta_m \cos(2\pi f_m t+\varphi_m)], \tag{3}$$

$$C_2(t) = C_0[1+\Delta_m \cos(2\pi f_m t+\varphi_m+\pi)], \tag{4}$$

where $\Delta_m$ is the modulation index, $C_0$ denotes the average capacitance, and a phase difference of 180° has been imposed between the signals that modulate each varactor. The time-modulated resonators create nonlinear harmonics on the circuit. For a given harmonic, the signals generated on both resonators have identical amplitude and a relative phase difference of nπ, with n∈ □ being the harmonic order that appears due to the different initial phases of the time-modulated capacitors. In general, the amplitude of each harmonic depends on a nontrivial manner on the antenna structure and the scheme applied to modulate the resonators, that is, the modulation frequency and modulation index ($f_m$, $\Delta_m$).

Antenna Layout

Figure 3:
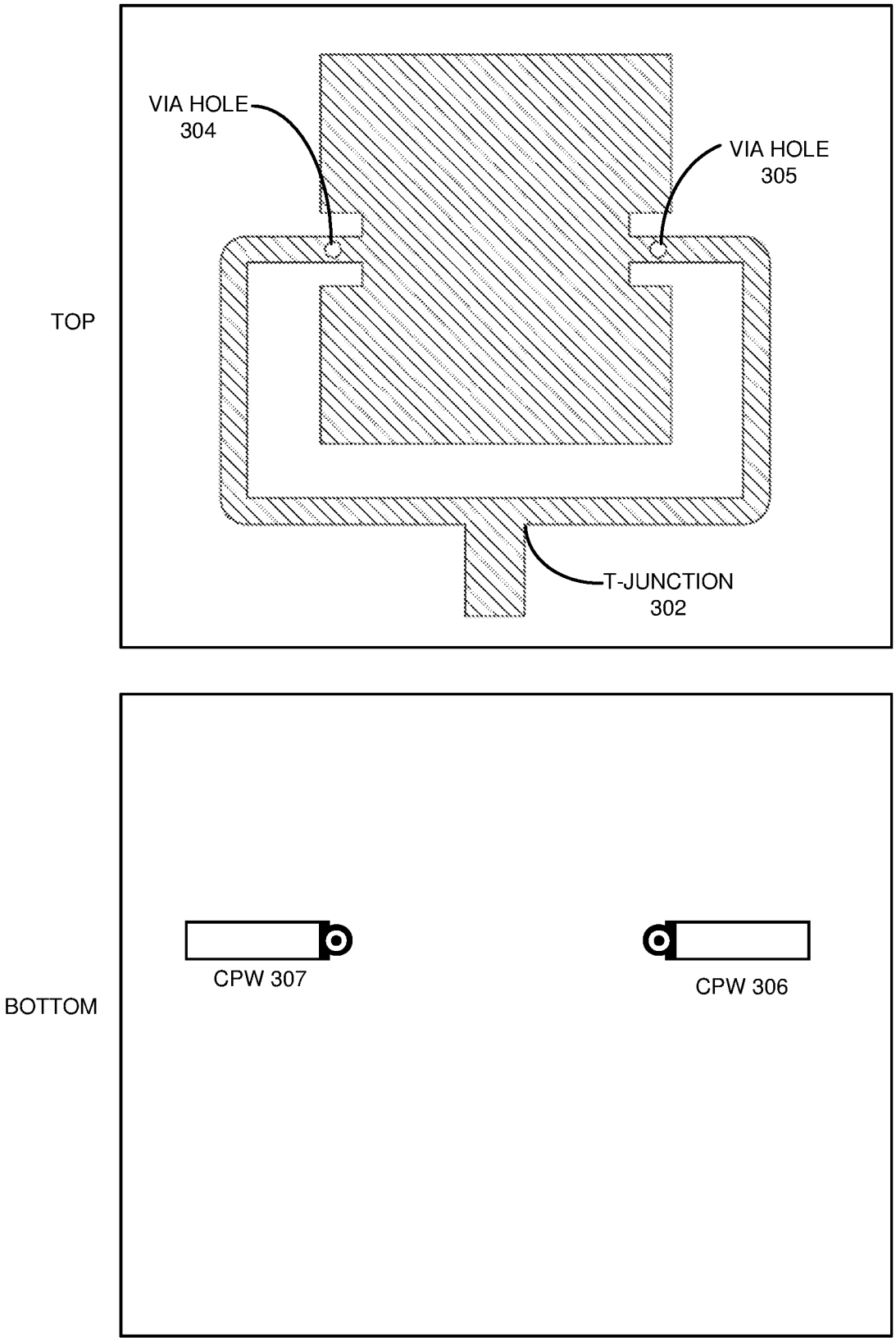
FIG. 3 illustrates an exemplary layout for a time-modulated patch antenna in accordance with the disclosed embodiments.

FIG. 3 illustrates an exemplary layout for a time-modulated patch antenna in accordance with the disclosed embodiments. Referring to the top side of the antenna, which is illustrated in the top portion of FIG. 3, note that this layout includes a T-junction 302 that connects a data signal into opposite sides of the patch antenna. In one implementation, the antenna is fabricated using a dielectric Roger Corporation laminate RT/duroid 5880 with a thickness, permittivity, and tangent loss of h=1.575 mm, $\varepsilon_r$=2.2, and tan δ=0.0009, respectively. In this implementation, the patch antenna includes two via holes 304-305 to facilitate connections to corresponding co-planar waveguides (CPWs) 306-307 located on a ground plane in the bottom side if the antenna, which is illustrated in the bottom portion of FIG. 3. Each of these CPWs 306-307 is associated a varactor (Skyworks SMV1233), which is used to apply time-modulation, and an inductor (TDK SIMID 33 nH) that behaves as a choke.

We next describe processes of operation for the nonreciprocal phased-array antenna described above.

Process of Operation

Figure 4A:
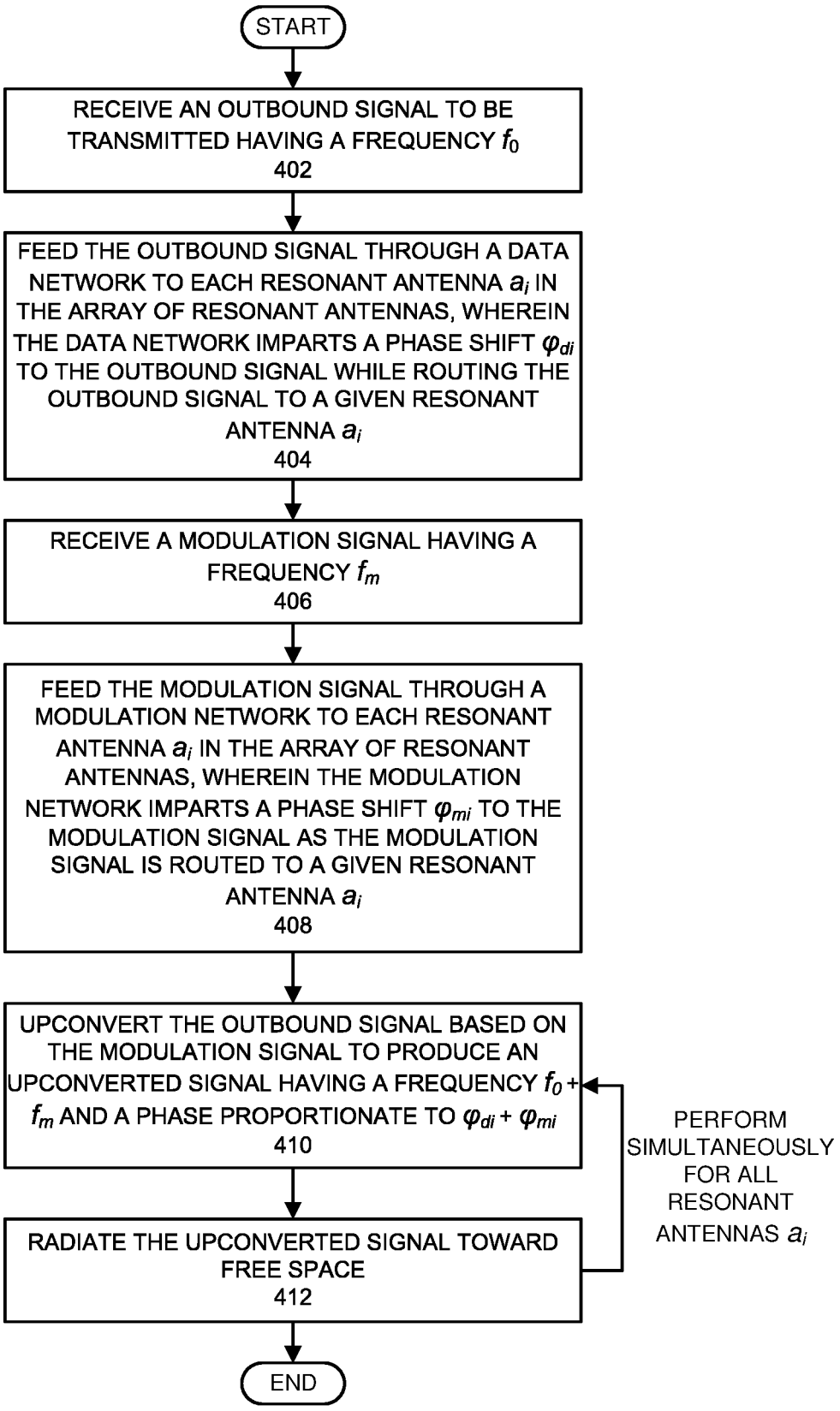
FIG. 4A presents a flow chart illustrating a process for transmitting an outbound signal through a nonreciprocal phased-array antenna in accordance with the disclosed embodiments.

FIG. 4A presents a flow chart illustrating a process for transmitting an outbound signal through a nonreciprocal phased-array antenna comprising an array of resonant antennas $a_1, \ldots, a_n$ in accordance with the disclosed embodiments. During operation, the system receives an outbound signal to be transmitted having a frequency $f_0$ (step 402). Next, the system feeds the outbound signal through a data network to each resonant antenna $a_i$ in the array of resonant antennas, wherein the data network imparts a phase shift $\varphi_{di}$ to the outbound signal while routing the outbound signal to a given resonant antenna $a_i$ (step 404). The system also receives a modulation signal having a frequency $f_m$ (step 406). Next, the system feeds the modulation signal through a modulation network to each resonant antenna $a_i$ in the array of resonant antennas, wherein the modulation network imparts a phase shift $\varphi_{mi}$ to the modulation signal as the modulation signal is routed to a given resonant antenna $a_i$ (step 408). Finally, simultaneously for all resonant antennas $a_i$, the system upconverts the outbound signal based on the modulation signal to produce an upconverted signal having a frequency $f_0+f_m$ and a phase proportionate to $\varphi_{di}+\varphi_{mi}$ (step 410), and radiates the upconverted signal toward free space (step 412).

Figure 4B:
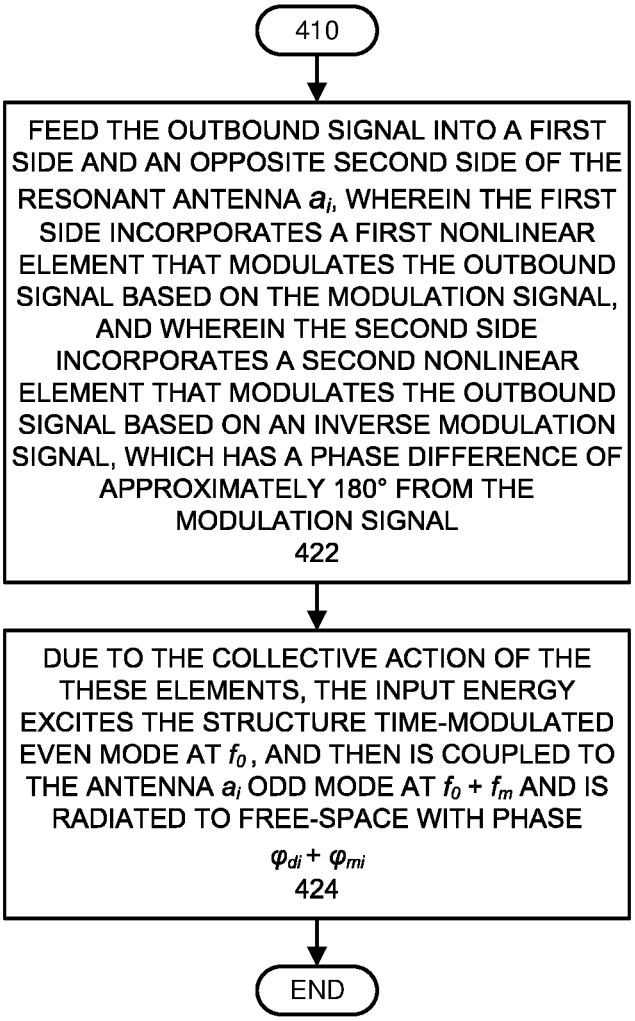
FIG. 4B presents a flow chart illustrating a process for upconverting an outbound signal in accordance with the disclosed embodiments.

FIG. 4B presents a flow chart illustrating a process for upconverting an outbound signal at a resonant antenna $a_i$ in accordance with the disclosed embodiments. (This flow chart illustrates in more detail the operations performed in step 410 of the flow chart in FIG. 4A.) During the upconversion process, the system feeds the outbound signal into a first side and an opposite second side of the resonant antenna $a_i$, wherein the first side incorporates a first nonlinear element that modulates the outbound signal based on the modulation signal, and wherein the second side incorporates a second nonlinear element that modulates the outbound signal based on an inverse modulation signal, which has a phase difference of approximately 180° from the modulation signal (step 422). Due to the collective action of these elements, the input energy excites the structure time-modulated even mode at $f_0$, and then is coupled to the antenna $a_i$ odd mode at $f_0+f_m$ and is radiated to free-space with phase $\varphi_{di}+\varphi_{mi}$ (step 424).

Figure 5A:
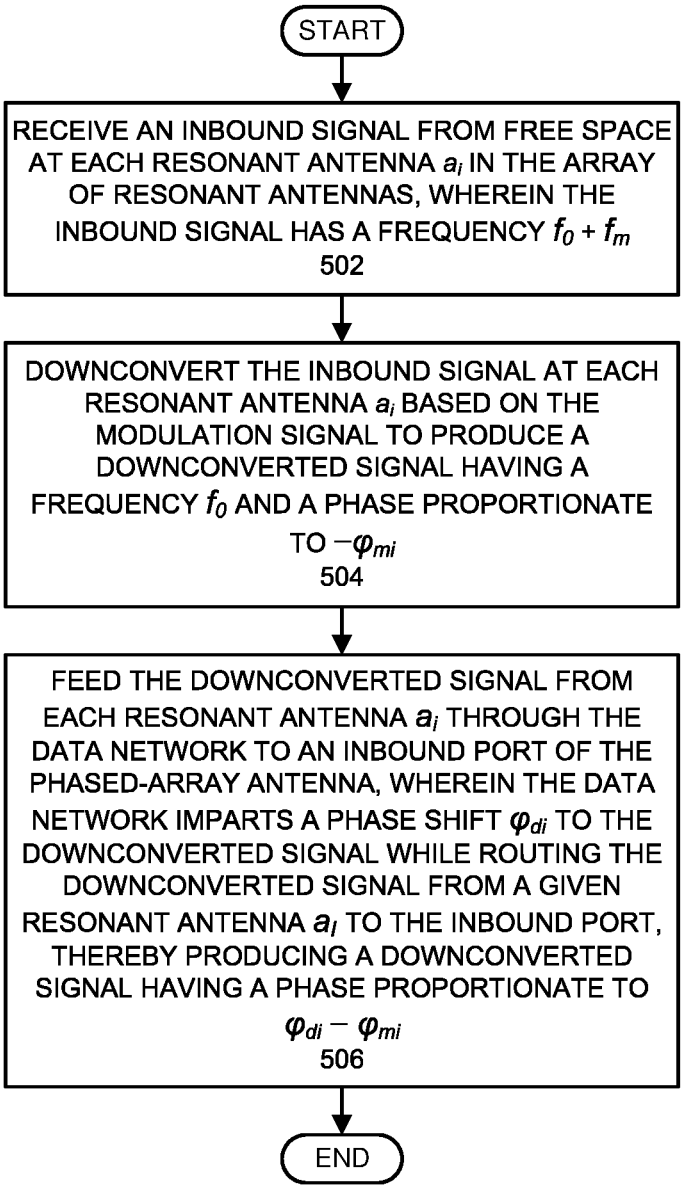
FIG. 5A presents a flow chart illustrating a process for receiving an inbound signal through a nonreciprocal phased-array antenna in accordance with the disclosed embodiments.

FIG. 5A presents a flow chart illustrating a process for receiving an inbound signal through a nonreciprocal phased-array antenna comprising an array of resonant antennas $a_1, \ldots, a_n$ in accordance with the disclosed embodiments. During operation, the system receives an inbound signal from free space at each resonant antenna $a_i$ in the array of resonant antennas, wherein the inbound signal has a frequency $f_0+f_m$ (step 502). Next, the system downconverts the inbound signal at each resonant antenna a based on the modulation signal to produce a downconverted signal having a frequency $f_0$ and a phase proportionate to $-\varphi_{mi}$ (step 504). The system then feeds the downconverted signal from each resonant antenna $a_i$ through the data network to an inbound port of the phased-array antenna, wherein the data network imparts a phase shift $\varphi_{di}$ to the downconverted signal while routing the downconverted signal from a given resonant antenna $a_i$ to the inbound port, thereby producing a downconverted signal having a phase proportionate to $\varphi_{di}-\varphi_{mi}$ ((step 506).

Figure 5B:
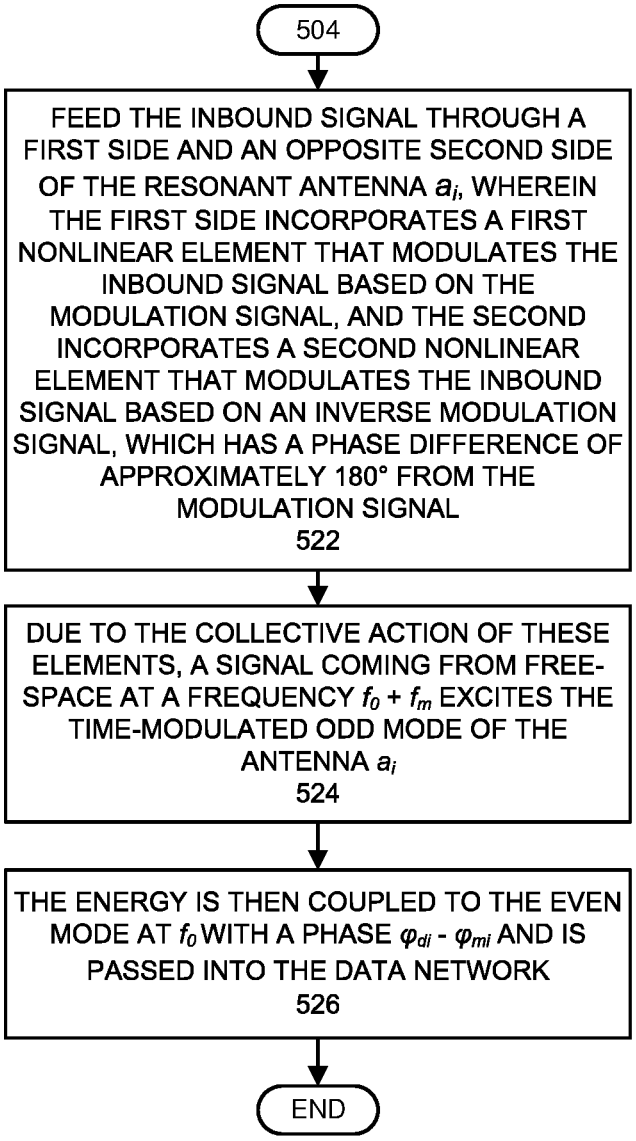
FIG. 5B presents a flow chart illustrating a process for downconverting an inbound signal in accordance with the disclosed embodiments.

FIG. 5B presents a flow chart illustrating a process for downconverting an inbound signal at a resonant antenna $a_i$ in accordance with the disclosed embodiments. (This flow chart illustrates in more detail the operations performed in step 504 of the flow chart in FIG. 5A.) During the downconversion process, the system feeds the inbound signal through a first side and an opposite second side of the resonant antenna $a_i$, wherein the first side incorporates a first nonlinear element that modulates the inbound signal based on the modulation signal, and the second incorporates a second nonlinear element that modulates the inbound signal based on an inverse modulation signal, which has a phase difference of approximately 180° from the modulation signal (step 522). Due to the collective actions of these elements, a signal coming from free-space at a frequency $f_0+f_m$ excites the time-modulated odd mode of the antenna $a_i$ (step 524). The energy is then coupled to the even mode at $f_0$ with a phase $\varphi_{di}-\varphi_{mi}$ and is passed into the data network (step 526).

Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the principles and features disclosed herein.

The foregoing descriptions of embodiments have been presented for purposes of illustration and description only. They are not intended to be exhaustive or to limit the present description to the forms disclosed. Accordingly, many modifications and variations will be apparent to practitioners skilled in the art. Additionally, the above disclosure is not intended to limit the present description. The scope of the present description is defined by the appended claims.

What is claimed is:

1. A nonreciprocal phased-array antenna, comprising:

an array of resonant antennas $a_1, \ldots, a_n$;

an outbound port that carries an outbound signal to be transmitted by the phased-array antenna;

an inbound port that carries an inbound signal received by the phased-array antenna;

a data network, which routes an outbound signal from the outbound port to each resonant antenna $a_i$ in the array of resonant antennas and while doing so imparts a phase shift $\varphi_{di}$ to the outbound signal, and which routes an inbound signal received at each resonant antenna $a_i$ to the inbound port and while doing so imparts a phase shift $\varphi_{di}$ to the inbound signal;

a modulation network that feeds a modulation signal having a frequency $f_m$ to each resonant antenna $a_i$ in the array of resonant antennas, wherein the modulation network imparts a phase shift $\varphi_{mi}$ to the modulation signal as the modulation signal is routed to a given resonant antenna $a_i$;

wherein during transmission, when an outbound signal is received at each resonant antenna $a_i$, the outbound signal is upconverted based on the modulation signal to produce an upconverted signal having a frequency $f_0+f_m$ and a phase proportionate to $\varphi_{di}+\varphi_{mi}$, and is radiated toward free space; and wherein during reception, when an inbound signal of frequency $f_0+f_m$ is received at each resonant antenna $a_i$, the inbound signal is downconverted based on the modulation signal to produce a downconverted signal having a frequency $f_0$ and a phase proportionate to $-\varphi_{mi}$, wherein after the downconverted signal passes through the data network to the inbound port, the downconverted signal has a phase proportionate to $\varphi_{di}-\varphi_{mi}$.

2. The nonreciprocal phased-array antenna of claim 1, wherein each resonant antenna $a_i$ comprises:

a junction that symmetrically connects the data network to opposite sides of the resonant antenna $a_i$, wherein the opposite sides include a first side and a second side;

a first nonlinear element, which is incorporated into the first side of the resonant antenna $a_i$, wherein the first element is modulated based on the modulation signal; and a second nonlinear element, which is incorporated into the second side of the resonant antenna $a_i$, wherein the second nonlinear element is modulated based on an inverse modulation signal, which has a phase difference of approximately 180° from the modulation signal.

3. The nonreciprocal phased-array antenna of claim 2, wherein during transmission, the input energy excites the time-modulated even mode of the structure at $f_0$ and, due to the collective action of the nonlinear elements, is coupled to the antenna $a_i$ odd mode at $f_0+f_m$ and is then radiated to toward free-space with phase $\varphi_{di}+\varphi_{mi}$.

4. The nonreciprocal phased-array antenna of claim 2, wherein during reception, the signal coming from free-space with frequency $f_0+f_m$ excites the time-modulated odd mode of the antenna $a_i$, and, due to the collective action of the nonlinear elements, is coupled to the structure even mode at $f_0$ and then passed into the data network.

5. The nonreciprocal phased-array antenna of claim 2, wherein the first and second nonlinear elements include varactors that act as tuning elements for the first and second sides of the antenna $a_i$.

6. The nonreciprocal phased-array antenna of claim 5, wherein each resonant antenna $a_i$ comprises:

a substrate composed of a dielectric material having a top surface and a bottom surface;

a ground plane comprising a metal layer bonded to the bottom surface of the substrate;

a patch antenna comprising a shaped metal sheet mounted on the top surface of the substrate;

a microstrip line printed on the top surface of the substrate that is connected to the data network and forms a junction to feed the patch antenna from the opposite sides;

two coplanar waveguides (CPWs) located in the ground plane, wherein each CPW is beneath the microstrip lines that feed the patch antenna, wherein the two CPWs carry the modulation signal and the inverse modulation signal; and two via-holes, each of which is loaded with a varactor and located on one side of the patch antenna to connect the microstrip line and the CPW located beneath the patch antenna.

7. The nonreciprocal phased-array antenna of claim 1, wherein each resonant antenna $a_i$ comprises:

a junction that symmetrically connects the data network to opposite sides of the resonant antenna $a_i$, wherein the opposite sides include a first side and a second side;

a first nonlinear element, which is incorporated into the first side of the resonant antenna $a_i$, wherein the first nonlinear element is modulated based on the modulation signal; and a second side of the resonant antenna, which does not incorporate a nonlinear element.

8. The nonreciprocal phased-array antenna of claim 1, wherein radiation patterns generated by the phased-array antenna during transmission and reception can be independently controlled by modifying the phases $\varphi_{di}$ and $\varphi_{mi}$.

9. The nonreciprocal phased-array antenna of claim 1, wherein the modulation network includes phase shifters that impart a phase shift $\varphi_{mi}$ to the modulation signal as the modulation signal is routed to each resonant antenna $a_i$.

10. A system that includes a nonreciprocal phased-array antenna, comprising:

a device that sends and receives signals through the nonreciprocal phased-array antenna; and the nonreciprocal phased-array antenna, which is coupled to the device, wherein the nonreciprocal phased-array antenna comprises:

an array of resonant antennas $a_1, \ldots, a_n$;

an outbound port that carries an outbound signal to be transmitted by the phased-array antenna;

an inbound port that carries an inbound signal received by the phased-array antenna;

a data network, which routes an outbound signal from the outbound port to each resonant antenna $a_i$ in the array of resonant antennas and while doing so imparts a phase shift $\varphi_{di}$ to the outbound signal, and which routes an inbound signal received at each resonant antenna $a_i$ to the inbound port and while doing so imparts a phase shift $\varphi_{di}$ to the inbound signal; and a modulation network that feeds a modulation signal having a frequency $f_m$ to each resonant antenna $a_i$ in the array of resonant antennas, wherein the modulation network imparts a phase shift $\varphi_{mi}$ to the modulation signal as the modulation signal is routed to a given resonant antenna $a_i$;

wherein during transmission, when an outbound signal is received at each resonant antenna $a_i$, the outbound signal is upconverted based on the modulation signal to produce an upconverted signal having a frequency $f_0+f_m$ and a phase proportionate to $\varphi_{di}+\varphi_{mi}$, and is radiated toward free space; and wherein during reception, when an inbound signal of frequency $f_0+f_m$ is received at each resonant antenna $a_i$, the inbound signal is downconverted based on the modulation signal to produce a downconverted signal having a frequency $f_0$ and a phase proportionate to $-\varphi_{mi}$, wherein after the downconverted signal passes through the data network to the inbound port, the downconverted signal has a phase proportionate to $\varphi_{di}-\varphi_{mi}$.

11. The system of claim 10, wherein each resonant antenna $a_i$ comprises:

a junction that symmetrically connects the data network to opposite sides of the resonant antenna $a_i$, wherein the opposite sides include a first side and a second side;

a first nonlinear element incorporated into the first side of the resonant antenna $a_i$, wherein the first nonlinear element is modulated based on the modulation signal; and a second nonlinear element incorporated into the second side of the resonant antenna $a_i$, wherein the second nonlinear element is modulated based on an inverse modulation signal, which has a phase difference of approximately 180° from the modulation signal.

12. The system of claim 10, wherein the system comprises a radar system.

13. The system of claim 10, wherein the system comprises a communication system.

* * * * *